US006595167B2

(12) United States Patent
Kaesgen

(10) Patent No.: US 6,595,167 B2
(45) Date of Patent: Jul. 22, 2003

(54) INTERNAL COMBUSTION ENGINE AND METHOD OF MAKING THE SAME

(75) Inventor: Hartmut Kaesgen, Berea, OH (US)

(73) Assignee: MTD Products Inc, Valley City, OH (US)

( * ) Notice: Subject to any disclaimer, the term of this patent is extended or adjusted under 35 U.S.C. 154(b) by 3 days.

(21) Appl. No.: 09/939,168

(22) Filed: Aug. 24, 2001

(65) Prior Publication Data

US 2002/0189570 A1 Dec. 19, 2002

Related U.S. Application Data

(60) Provisional application No. 60/292,579, filed on May 22, 2001.

(51) Int. Cl.[7] ..... F02B 75/22
(52) U.S. Cl. ..... 123/55.2; 123/197.4
(58) Field of Search ..... 123/55.2, 197.4, 123/90.61, 48 C, 78 C

(56) References Cited

U.S. PATENT DOCUMENTS 4,638,769 A * 1/1987 Ballheimer ..... 123/41.84
5,197,432 A 3/1993 Ballheimer
5,983,849 A * 11/1999 Wangen et al. ..... 123/90.61

FOREIGN PATENT DOCUMENTS

EP 0 611 878 A1 8/1994
JP 56-6043 1/1981

OTHER PUBLICATIONS

Zavo, Q52 98–396527/34 RU 2099551–C1, 1998 Derwent Information (abstract).
Technique, "Moteur Modulair Volvo: Trois Cylindrees," pp. 17 & 19, No. 22, May 28, 1992.

* cited by examiner

*Primary Examiner*—Tony M. Argenbright
*Assistant Examiner*—Katrina B. Harris

(57) ABSTRACT

A modular engine design system utilizes selectively replaceable components whereby a family of related engines having varying power outputs may be produced. A first series of engines utilizes a common piston operable in a cylinder of first predetermined dimensions. The engine design may utilize a first or second crankshaft/connecting rod combination to vary the power output. A modified engine design utilizes a second cylinder in addition to the first cylinder. A second series of engines utilizes a larger piston operable in a cylinder of second predetermined dimensions. The second series of engines shares a common engine design scheme with the first series of engines. However, corresponding parts are adapted for use with the larger piston/cylinder combination. The second series of engines may likewise utilize a first or second crankshaft/connecting rod combination to vary the power output.

8 Claims, 9 Drawing Sheets

INTERNAL COMBUSTION ENGINE AND METHOD OF MAKING THE SAME

This Utility Patent Application claims priority from Provisional Patent Application Ser. No. 60/292,579 filed May 22, 2001.

BACKGROUND OF THE INVENTION

1. Field of Invention

The invention relates to the field of engines and methods of manufacturing engines and more particularly to an engine, and a method of making the engine, that allows for a number of engines of varying horsepower outputs to be manufactured from a relatively small number of basic engine components.

2. Description of the Related Art

Internal combustion engines are known in the art. Various methods of manufacturing such internal combustion engines have been devised and disclosed.

Some have tried to streamline and improve the process of manufacturing internal combustion engines. For example, U.S. Pat. No. 4,622,864 to Fetouh purports to disclose a reciprocating piston engine including a modular power transmission sub-assembly. The invention purports to provide a lightweight and low-cost engine construction.

U.S. Pat. No. 3,941,114 to Seifert purports to disclose a cylinder crankcase for a multi-cylinder internal combustion engine in which the crankcase consists of welded-together cast housing elements that are connected in series in a building-block-like matter.

U.S. Pat. No. 5,456,076 to Zornes discloses an external heat source engine that includes a telescopic crankcase structure. The engine structure may be constructed so that two or more sub-systems are housed in one or more modules according to the specification of the patent. Two or more power modules may then be coupled together and engine power and speed control may be obtained by varying the relative phase angle of the couple.

U.S. Pat. No. 4,676,205 to Kaufman purports to disclose and arrangement for mounting a two-stroke cycle vertical crankshaft internal combustion engine onto a rotary mower deck to accept a four-stroke cycle vertical crankshaft internal combustion engine whereby either type of engine may be adapted to the same mower deck.

U.S. Pat. No. 4,610,228 to Fink et al. purports to disclose a crankcase assembly for an engine to be mounted to and associated with a portable tool such as a chain saw. A plastic crankcase is connected to the cylinder of the engine and an annular insulating member is mounted between the cylinder and the crankcase.

In light of the prior art, the possibility for improvements still remain and are desirable for improving the efficiency and cost of the manufacturing process for engines, and especially smaller horsepower internal combustion engines such as might be used in the lawn care industry. In this industry, for smaller lawn care products, a large percentage of the product cost is due to the cost of the engine itself. For example, as of the date of filing this patent application, it is not uncommon for some walk behind lawn mowers to cost less than $100 even though those walk-behind lawn mowers are provided with an internal combustion engine of five horsepower or more. With cost pressure keeping the retail price of this product low, it is important that improvements in the efficiencies in the manufacture and design of the engine itself be made in order to provide adequate profit to the manufacturer of the lawn mower.

SUMMARY OF THE INVENTION

According to one aspect of the present invention, a method of providing a family of engines so that greater manufacturing efficiencies are obtainable is disclosed. The invention provides a modular engine design system for designing a family of engines. The engines in the family of engines provide for a variety of power outputs to be achieved without major redesigning of engine components. Each engine comprises at least one cylinder block defining a cylinder therein, a crankcase having an opening therein communicating with the cylinder, a piston adapted for reciprocal movement in the cylinder, a crankshaft adapted for rotational movement within the crankcase, a connecting rod interconnecting the piston and the crankshaft, and a camshaft for controlling the intake valve and exhaust valve assembly.

In accordance with the invention, the modular engine design system provides a basic engine design capable of generating a first range of power output. For illustrative purposes only, and not by way of limiting the present invention, the basic engine, for example, may be capable of generating about 3.5 to 4.5 horsepower, inclusive. The basic engine design utilizes basic engine components, designated by the letter A, which include: a first cylinder block (A) defining a first cylinder (A) of first predetermined dimensions, a first crankcase (A), a first piston (A), a first crankshaft (A), a first connecting rod (A) of length $L_1$, and a first camshaft (A).

In accordance with the invention, the modular engine design system provides a second engine design for providing a second engine capable of generating a second range of power output, greater than the power output of the basic engine. The modular engine design system utilizes a plurality of engine components that are substantially structurally identical to the basic engine components in order to achieve the desired power output range. For ease of illustration, different alphabetic labels will identify engine components that differ structurally from the basic engine components.

The second engine design may, for example, provide an engine capable of generating about 5.0 to 6.5 horsepower. This second engine design would utilize a plurality of the basic engine components. For example, the second engine design might utilized a first cylinder block (A), defining a cylinder (A) having the same predetermined dimensions, a first piston (A), a first crankcase (A), and a first camshaft (A) are basic engine components utilized in the second engine design.

However, in the inventive engine design system, several of the basic components are selectively replaceable with modified components. For instance, in the exemplary second engine design, the first connecting rod (A) is selectively replaced with a second connecting rod (B), having a length $L_2$. Likewise, first crankshaft (A) is selectively replaced by second crankshaft (B). In this example, $L_2$ is less than $L_1$. The power output is directly related to the amount of displacement, or piston stroke, of the piston within the cylinder. In a cylinder of predetermined diameter, a longer stroke correlates to a greater cylinder volume, and a shorter stroke correlates to a lesser cylinder volume. A shorter connecting rod allows for a longer stroke within cylinders of the same predetermined dimensions, and hence more power. Therefore, in the modular engine design system of the present invention, changes in the length of the connecting rod, while keeping the cylinder/piston dimensions the same, provide for the changes in power output from the basic engine to the second engine in the family of engine designs.

The modular engine design system utilizes several common engine-building components that are adapted to be used with modified engine components to provide a family of engines of varying power outputs. Therefore, in the modular engine design system, greater manufacturing efficiencies can be achieved.

In accordance with yet another feature of the invention, a third engine design is provided. The third engine design utilizes a third crankshaft (C) adapted to receive two first connecting rods (A, A), each having a length $L_1$, which are operatively connected to two first pistons (A, A). This third engine design utilizes two of the first cylinder blocks (A, A), each of which define a first cylinder (A) of first predetermined dimensions. A modified crankcase (B) is provided which has one opening that communicates with one of the cylinders and a second opening that communicates with the second cylinder. A modified camshaft (B) is also provided to operate the valve assemblies associated with each cylinder/piston combination.

In accordance with yet another feature of the invention, a fourth engine having a power output greater than the basic engine is provided through a fourth engine design. Again, a plurality of basic engine components is utilized. For example, the fourth engine design utilizes a fourth crankshaft (D) adapted to receive two of the second connecting rods (B, B), each having a length $L_2$, which are operatively connected to two first pistons (A, A). The fourth engine design utilizes two of the first cylinder blocks (A, A), and the modified crankcase (B), as above. This fourth engine design utilizes the modified camshaft (B).

The second engine design differs from the basic engine design mainly by differing the stroke length of the piston. The third engine design differs from the basic engine design mainly by the addition of a second cylinder/piston combination. The fourth engine design differs from the basic engine design by combining the change in stroke length of the piston with the addition of a second cylinder/piston combination. Each engine design in associated with its own crankshaft to accommodate the different stroke lengths of the pistons and/or the number of pistons.

This concept of a modular engine design system that provides for a related series of engines is extended further in the present invention by providing a second series of engine designs. The second series of engine designs utilizes a common engine design scheme with the first series of engines. Therefore, the same modular concepts are used to create another family of related engines. The basic engine design of the second series utilizes a modified cylinder block (B) defining a modified cylinder (B) of predetermined dimensions greater than the dimensions of the first cylinder. The change in cylinder size provides a series of engine designs capable of providing engines with greater power output than the corresponding engines in the first series. An enlarged piston (B) is adapted for reciprocal movement within the modified cylinder (B) and is connected to another modified crankshaft (D) by a modified connecting rod (C) having length L3. A modified crankcase (C) has an opening therein adapted for communicating with the modified cylinder (B). This particular engine design utilizes yet another modified camshaft (C).

The present invention is further directed to modifications in the design of the basic engine of the second series corresponding to the changes in the design of the basic engine of the first series. As in the first series, other engines in this second series are produced by utilizing a connecting rod (D) having a length L4 less than L3. Additional engines in this family are provided by utilizing a second cylinder/piston combination with shorter or longer connecting rods. As in the first series of engine designs, modifications to the crankshaft, crankcase and camshaft are also provided.

In accordance with the present invention, there is provided a method of providing a family of engines sharing a common engine design scheme. The method comprises the steps of providing a first engine design for a basic engine having a first power output. The first engine is formed of basic engine components including a first cylinder block, a first crankcase, a first piston, a first crankshaft, a first connecting rod, and a first camshaft. The method further comprises the step of providing a second engine design for a second engine related to the first engine wherein at least one of the basic engine components is selectively replaced with a corresponding modified engine component substantially different from the replaced basic engine component. In that way, the second engine is associated with a power output substantially different from the first power output.

According to another aspect of the invention, a common engine design scheme is adapted to utilize a second cylinder block rather than the first cylinder block. Corresponding engine parts are therefore selectively replaced for use with the second cylinder block.

According to a further aspect of the invention, an engine having a first power output rating includes a crankcase that has first and second substantially symmetrical portions.

According to a further aspect of the invention, the first engine includes a piston that is received for reciprocal movement within a cylinder along a piston axis, the engine including a crankcase that is divided into first and second portions along a plane that is angled relative to the piston axis.

According to a further aspect of the invention, the engine includes a piston that is received for reciprocal movement with a cylinder along a piston axis, the engine including a crankcase that is divided into first and second portions along a plane that is substantially perpendicular to the piston axis.

One object of the invention is to provide an internal combustion engine for the generation of power.

Another object of the invention is to provide an internal combustion engine specifically adapted for smaller horsepower applications, such as lawn care products, such as lawn mowers, riding lawn mowers, snow throwers, tillers, and the like.

Another object of the invention is to provide engines of varying horsepower generating capabilities that can be efficiently and inexpensively manufactured.

Another object of the invention is to provide a family of engines related by use of common engine components.

Another object of the invention is to provide first and second series of engines utilizing similar design modifications between family members in each series.

Another object of the invention is to provide a business method whereby internal combustion engines of varying horsepower generating capabilities may be more efficiently produced.

One advantage of the present invention is that engines with a wide range of power outputs can be easily provided by selective replacement of basic engine components with modified engine components.

Other benefits flowing from the invention are reduced inventory costs and reduced manufacturing costs.

Still other benefits and advantages of the invention will become apparent to those skilled in the art to which it pertains upon a reading and understanding of the following detailed specification.

BRIEF DESCRIPTION OF THE DRAWINGS

The invention may take physical form in certain parts and arrangement of parts, a preferred embodiment of which will be described in detail in this specification and illustrated in the accompanying drawings that form a part hereof and wherein.

DETAILED DESCRIPTION OF THE INVENTION

Figure 1:
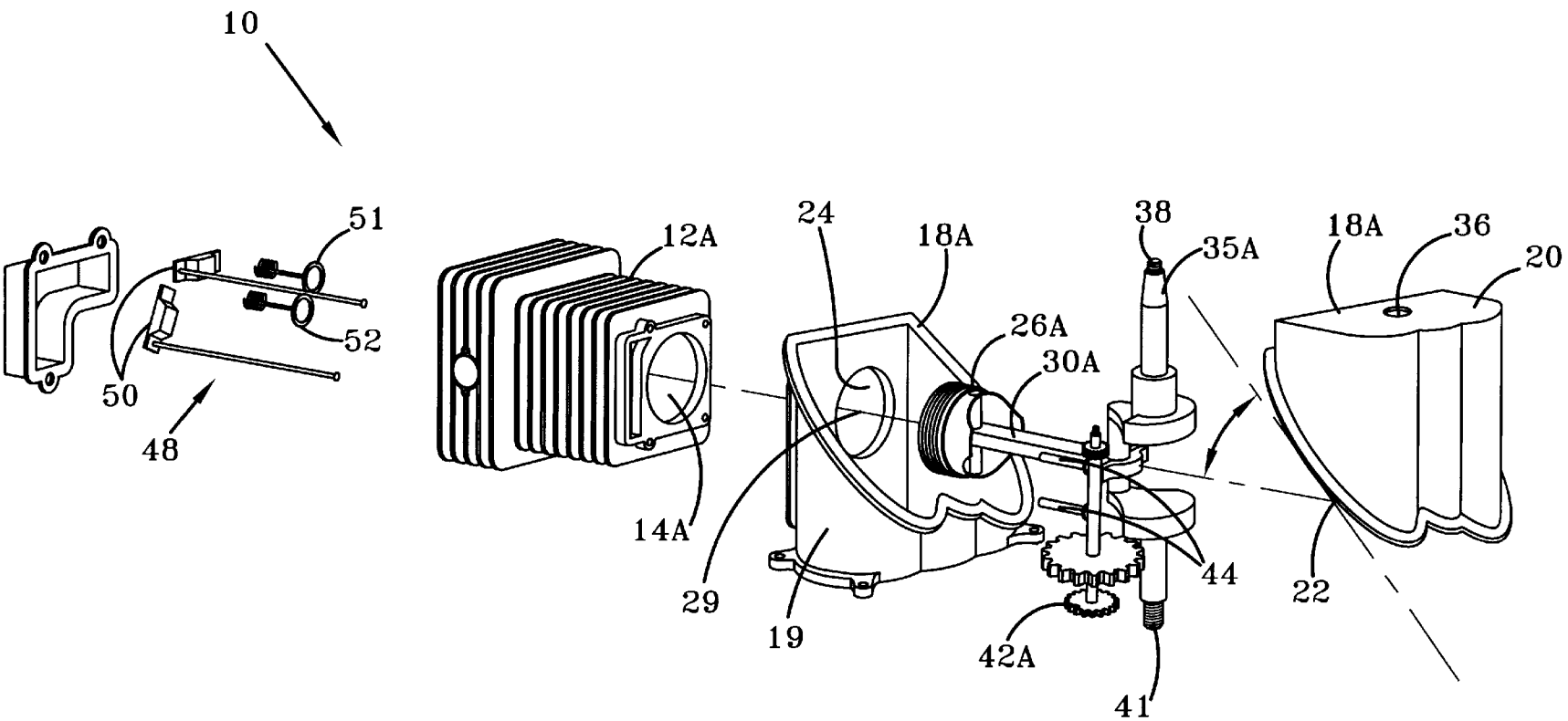
FIG. 1 is a perspective, partially exploded view of an embodiment of a first engine according to the invention.

With reference now to the drawings, which illustrate the preferred embodiments of the invention, FIG. 1 shows a basic engine 10 formed of a plurality of basic engine components. For ease of illustration, basic engine components will be designated with the letter (A), while modified engine components will be labeled with other alphabetic indicators. The basic engine 10 includes a cylinder block 12(A) that has a cylindrically shaped bore therein referred to as a cylinder 14(A). The basic engine 10 also includes a crankcase 18(A). In the preferred embodiment, crankcase 18(A) includes a first half 19 and a second half 20. In the preferred embodiment the crankcase 18(A) is split along a diagonal line 22 as illustrated.

The crankcase 18(A) includes an opening 24 adapted to communicate with cylinder 14(A). A piston 26(A) is adapted for reciprocal movement along a piston axis 29 through opening 24 and within cylinder 14(A). The piston 26(A) is operatively connected to crankshaft 35(A) by connecting rod 30(A). A first hole 36 in the crankcase 18(A) receives one end 38 of the crankshaft 35(A), while a second hole (not shown in this view) in crankcase 18(A) receives the other end 41 of the crankshaft 35(A).

The basic engine 10 further includes a camshaft 42(A) operably associated with the crankshaft 35(A). Lobes 44 provided on camshaft 42(A) direct the motion of valve assembly 48, including tappets 50, a first intake valve 51 and a first exhaust valve 52. The selective opening and closing of valves in response to rotational movement of a camshaft is well known in the art. It is further known in the art to provide reciprocal movement of a piston within a cylinder through operation of a crankshaft and connecting rod.

In a preferred embodiment, the specific engine size and capabilities contemplated are such that basic engine 10 could generate approximately 3.5 to 4.5 horsepower. However, it is within the scope of the present invention to design a basic engine 10 as shown in FIG. 1 having a predetermined range of power output different than the exemplary one given here.

A key element of this invention is the interrelationship between the basic engine 10 shown in FIG. 1 and the other engines in the same family of engines, examples of which are illustrated in FIGS. 2 through 8. In particular, FIGS. 1–4 illustrate a first series of engines, while FIGS. 5–8 illustrate a second series of engines. In the inventive modular engine design system, one or more basic engine components that form basic engine 10 are selectively replaced with modified engine components to provide a related engine with a substantially different power output. For example the basic engine 10 of FIG. 1 uses a certain piston 26(A), cylinder 14(A), connecting rod 30(A), crankshaft 35(A), camshaft 42(A) and crankcase 18(A). Many of these same engine components can be used in subsequent engines having different horsepower capabilities. Further, the inventive concept can be expanded to include other engine components as well as those enumerated above. Those additional engine components include carburetors and mufflers, among others. The inventor believes that the use of identical engine components in multiple engine designs, each design having different horsepower capabilities, provides significant and substantial opportunities to lower the cost of manufacturing the engines. The basic engine structure utilizes modular first engine components that are readily adapted for selective replacement with modified engine components.

Figure 2:
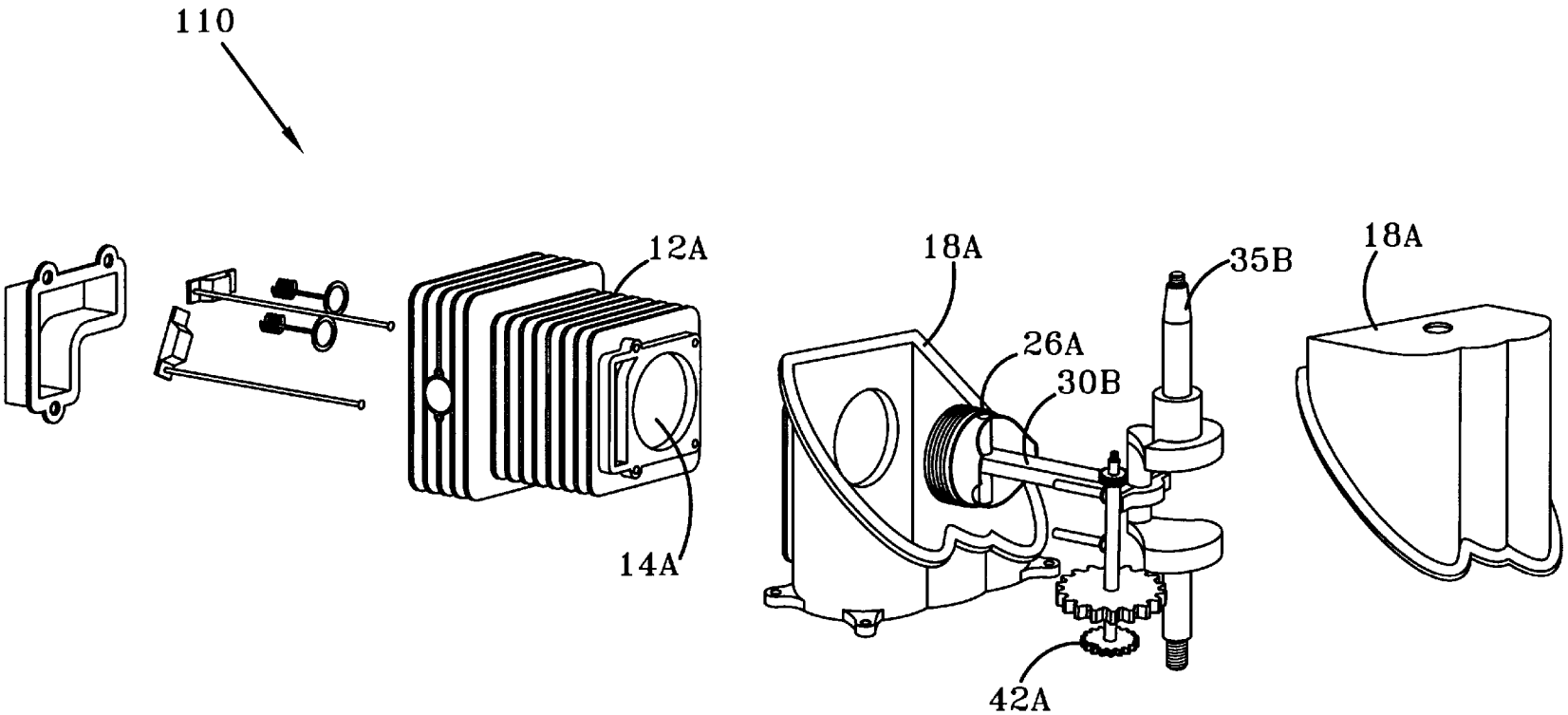
FIG. 2 is a perspective, partially exploded view of an embodiment of a second engine according to the invention.

For example, with reference to FIG. 2, a second engine 110 is illustrated. The engine 110 is related to basic engine 10 in that the two engine designs share many common components. In this illustrative example, second engine 110 features cylinder block 12(A), cylinder 14(A), crankcase 18(A), camshaft 42(A) and piston 26(A). However, second engine 110 differs in design from basic engine 10 in that connecting rod 30(A) and crankshaft 35(A) are selectively replaced with modified components: connecting rod 30(B) and crankshaft 35(B).

In second engine 110, the stroke of the piston 26(A) is longer than the stroke of piston 26(A) in the basic engine 10. The change in stroke is accomplished through a modified connecting rod 30(B) having length $L_2$, which is less than $L_1$, and modified crankshaft 35(B). The longer stroke length of piston 26(A) provides a greater operative cylinder volume, even though the physical dimensions of cylinder 14(A) remain constant between the two engine designs. The manufacturing efficiencies of the invention are attributable to the fact that in the illustrated components, only the crankshaft 35(B) and the connecting rod 30(B) are different, the other components in engines 10 and 110 are identical; yet they produce different horsepower capabilities. The basic engine 10 can produce, for example, approximately 3.5 to 4.5 horsepower, while the second engine 110 can produce, for example, about 5.0 to 6.5 horsepower. The engine 10 has an operative volume of about 165 cubic centimeters while engine 110 has an operative volume of approximately 210 cubic centimeters.

Figure 3:
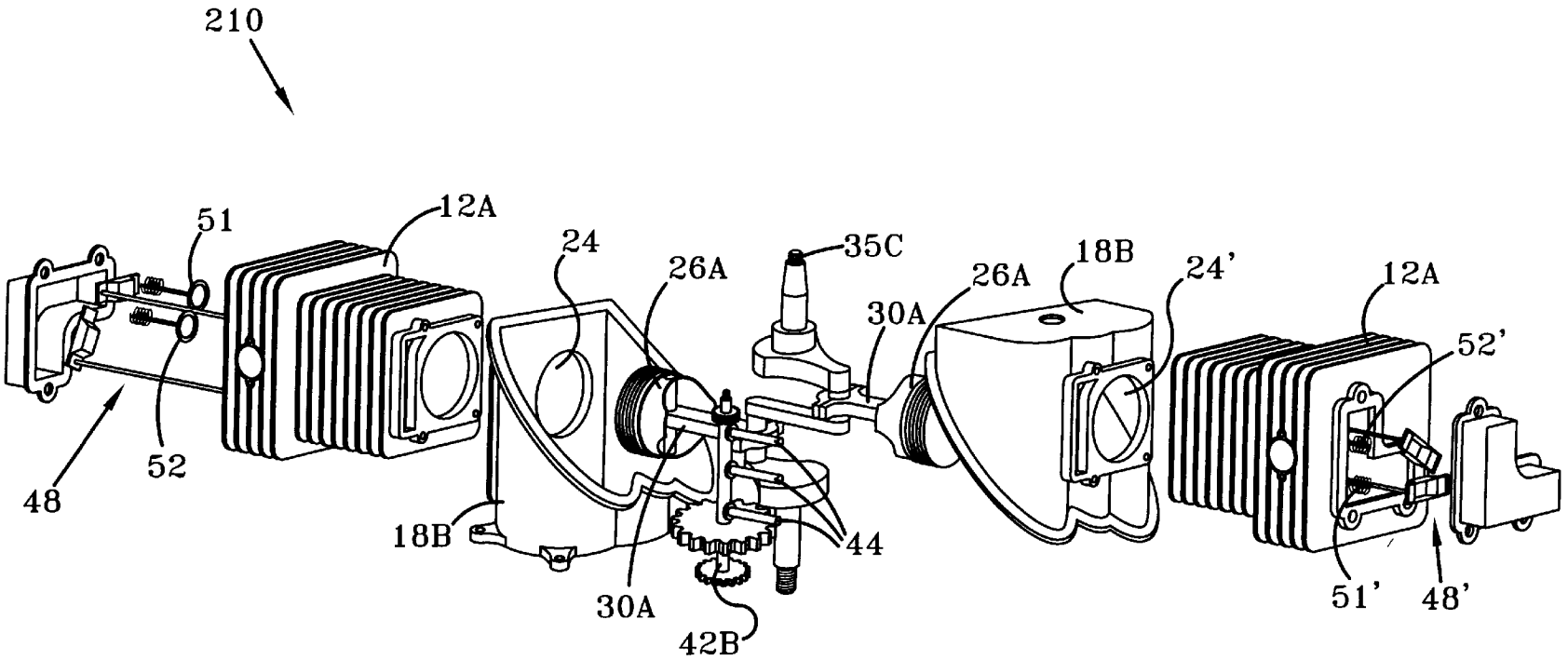
FIG. 3 is a perspective, partially exploded view of an embodiment of a third engine according to the invention.
Figure 4:
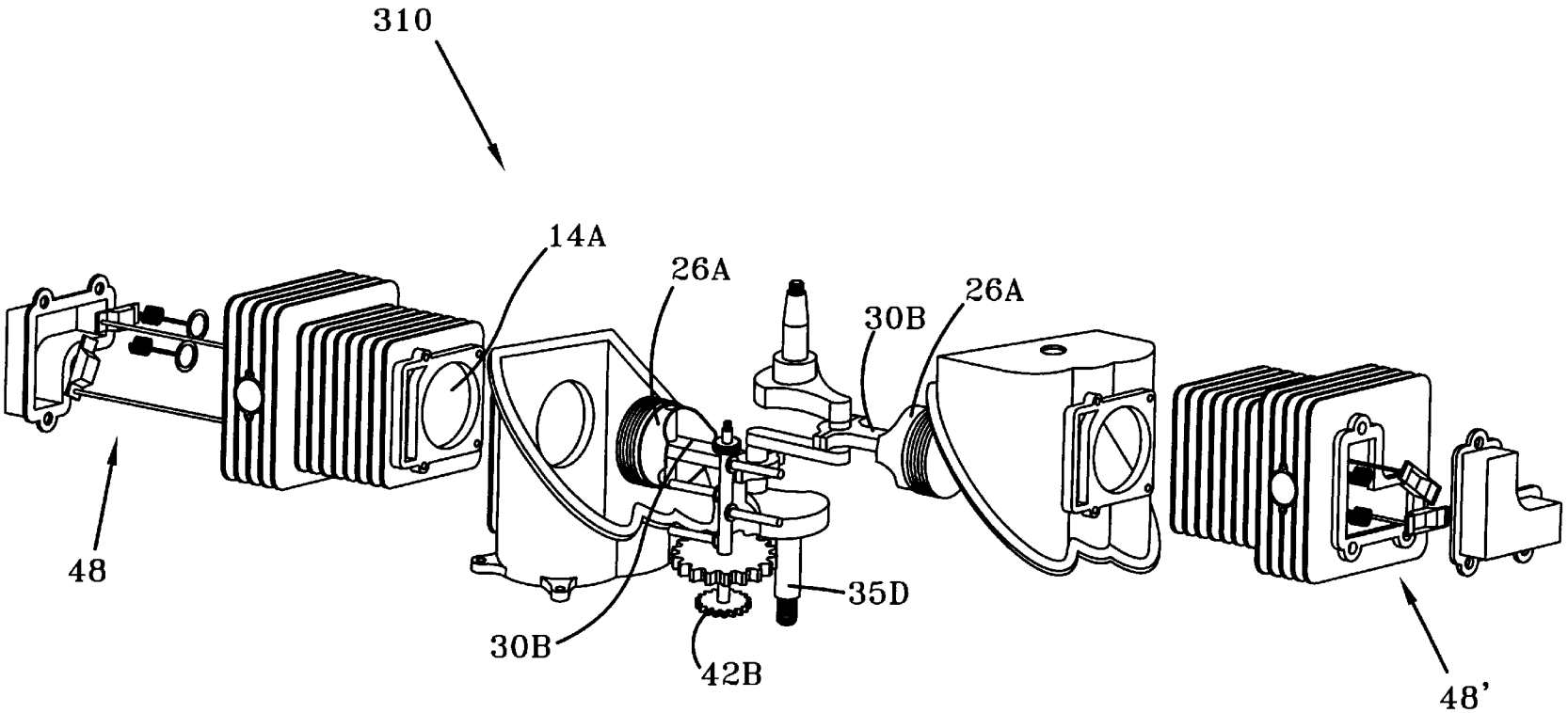
FIG. 4 is a perspective, partially exploded view of an embodiment of a fourth engine according to the invention.

With reference to FIG. 3, a third engine 210, related to basic engine 10 is illustrated. The structure of third engine 210 differs from basic engine 10 in that two cylinder/piston combinations are provided. Third engine 210 is capable of significantly different power output than basic engine 10, however, many of the basic engine components are utilized to achieve that result. For example, two of the basic cylinder blocks 12(A) are adapted to each receive one of two pistons 26(A). Each piston 26(A) is operatively connected to a modified crankshaft 35(C) through a connecting rod 30(A). A modified camshaft 42(B) is provided to operate the valve assemblies 48, 48' for each cylinder/piston combination. As illustrated, a single camshaft 42(B) is utilized to operate both valve assemblies 48, 48'. Camshaft 42B differs from camshaft 42A in that three lobes 44 are provided. A single lobe 44 operates both intake valves 51, 51' while separate lobes 44 operate the exhaust valves 52, 52'. Further, a modified crankcase 18(B) is provided having two openings 24, 24' therein, each opening communicating with one of the cylinders 14(A).

Synergistic manufacturing advantages are available when engines conforming to the designs given above are manufactured. For example, the relationship between components used on basic engine 10, second engine 110, and third engine 210 has been discussed. Basic engine 10 differs from second engine 110 due to the difference in length of connecting rods 30(A) or 30(B). Basic engine 10 differs from third engine 210 due to the inclusion of a second piston/cylinder combination. In each of these designs, the cylinder block 12(A) provides a cylinder 14(A) having constant dimensions. Likewise, a common piston 26(A) is utilized in each design.

Similar efficiencies can be obtained by combining the two methods of relating engines of differing horsepower capabilities. For example, with reference to FIG. 4, a fourth engine 310 is illustrated. Providing a pair of cylinders 14(A), a pair of pistons 26(A), and a pair of modified connecting rods 30(B) yields yet another related engine design. Each piston 26(A) is operatively connected to yet another modified crankshaft 35(D). Crankshaft 35(D) accommodates the pair of connecting rods 30(B). The stroke of each of the pistons 26(A) for fourth engine 310 is comparable to the stroke of the piston 26(A) of the second engine 110. Therefore, fourth engine 310 provides a power output significantly different than first engine 10, second engine 110, and third engine 210. Fourth engine 310 utilizes a camshaft 42(B) to operate two sets of valve assemblies 48, 48' in a manner similar to third engine 210. The third engine 210 can produce, for example, approximately 7–9 horsepower, while the fourth engine 310 can produce, for example, about 10–13 horsepower.

Figure 5:
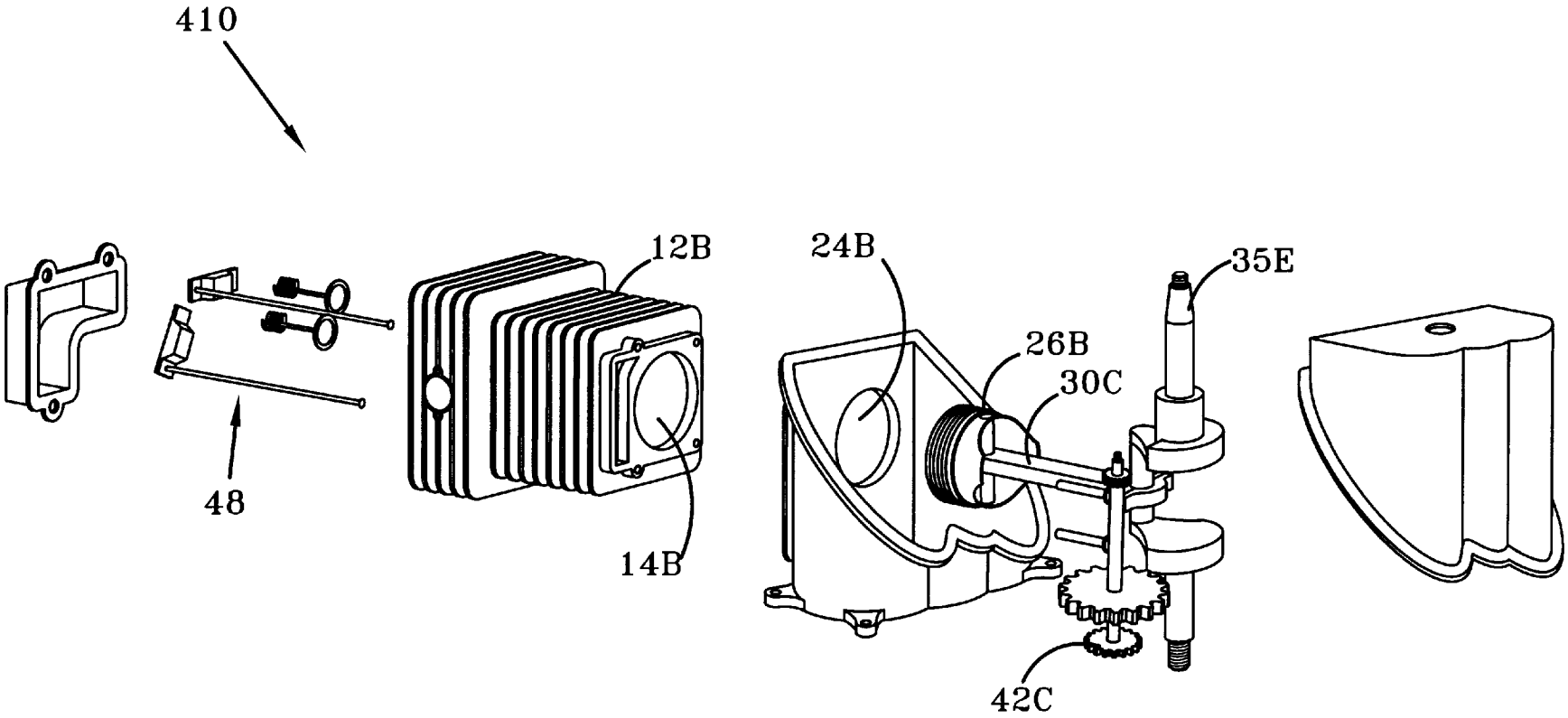
FIG. 5 is a perspective, partially exploded view of an embodiment of a fifth engine according to the invention.

With reference now to FIG. 5, fifth engine 410 is illustrated, the design of which forms the basis for a second series of engines. A fundamental difference between basic engine 10 and the second basic, or fifth engine 410 is that the cylinders of each engine differ in physical dimensions, although a similar engine design scheme is used. Each of the previously described engines utilized cylinder 14(A) having first predetermined dimensions. Fifth engine 410, however, utilizes cylinder block 12(B) that defines a cylinder 14(B) therein. Cylinder 14(B) has a greater diameter than cylinder 14(A). Fifth engine 410 further utilizes a larger-sized piston 26B adapted for the larger-sized cylinder 14(B).

A modified crankcase 18(C) includes opening 24(B) adapted to accommodate the larger-sized piston 26(B). Connecting rod 30(C) interconnects piston 26(B) to crankshaft 35(E). In the preferred embodiment, connecting rod 30(C) is associated with a length $L_3$ which may be the same or different from $L_1$ or $L_2$. As with the other series of engines, fifth engine 410 includes a camshaft 42(C) operably associated with crankshaft 35(C). An identical valve assembly 48 is operatively associated in like manner with camshaft 42(C).

Figure 6:
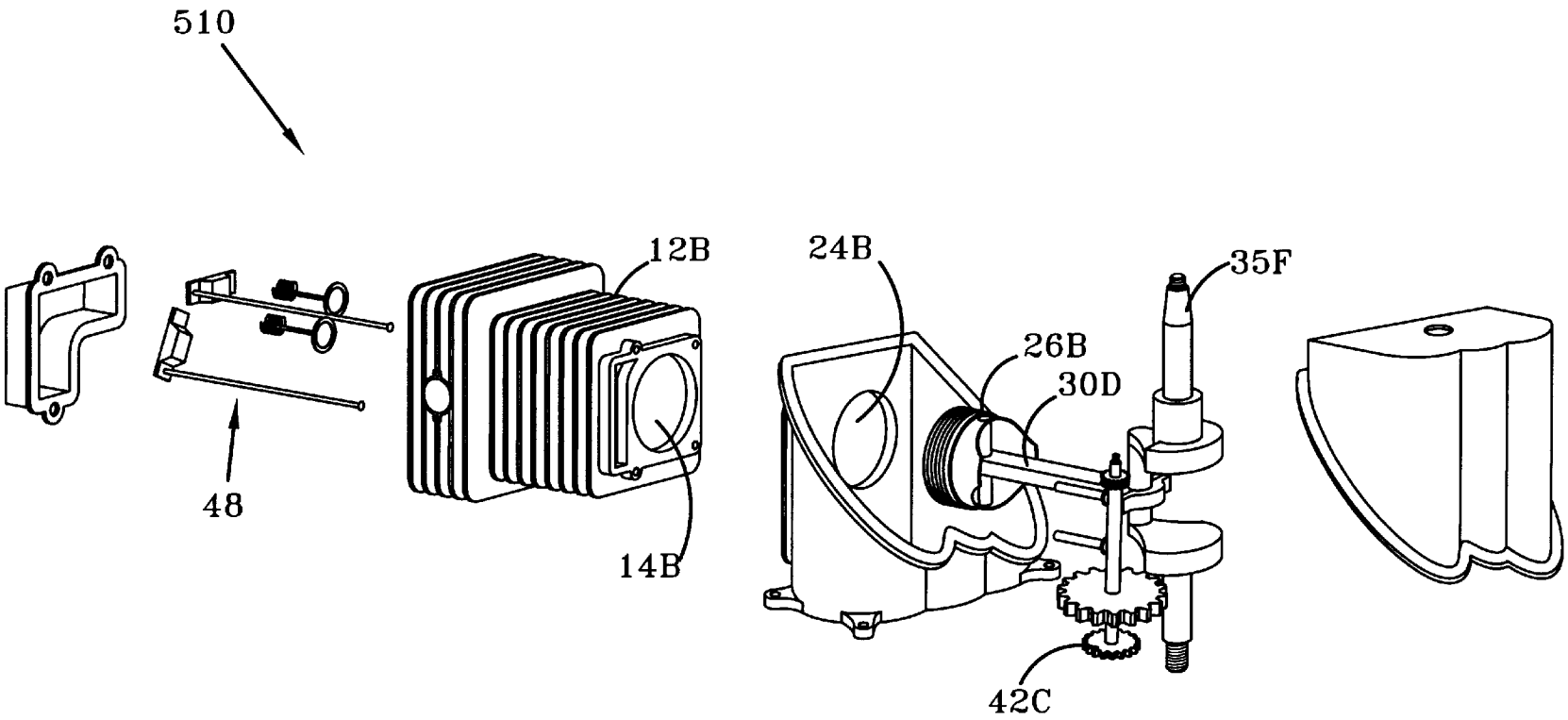
FIG. 6 is a perspective, partially exploded view of an embodiment of a sixth engine according to the invention.
Figure 7:
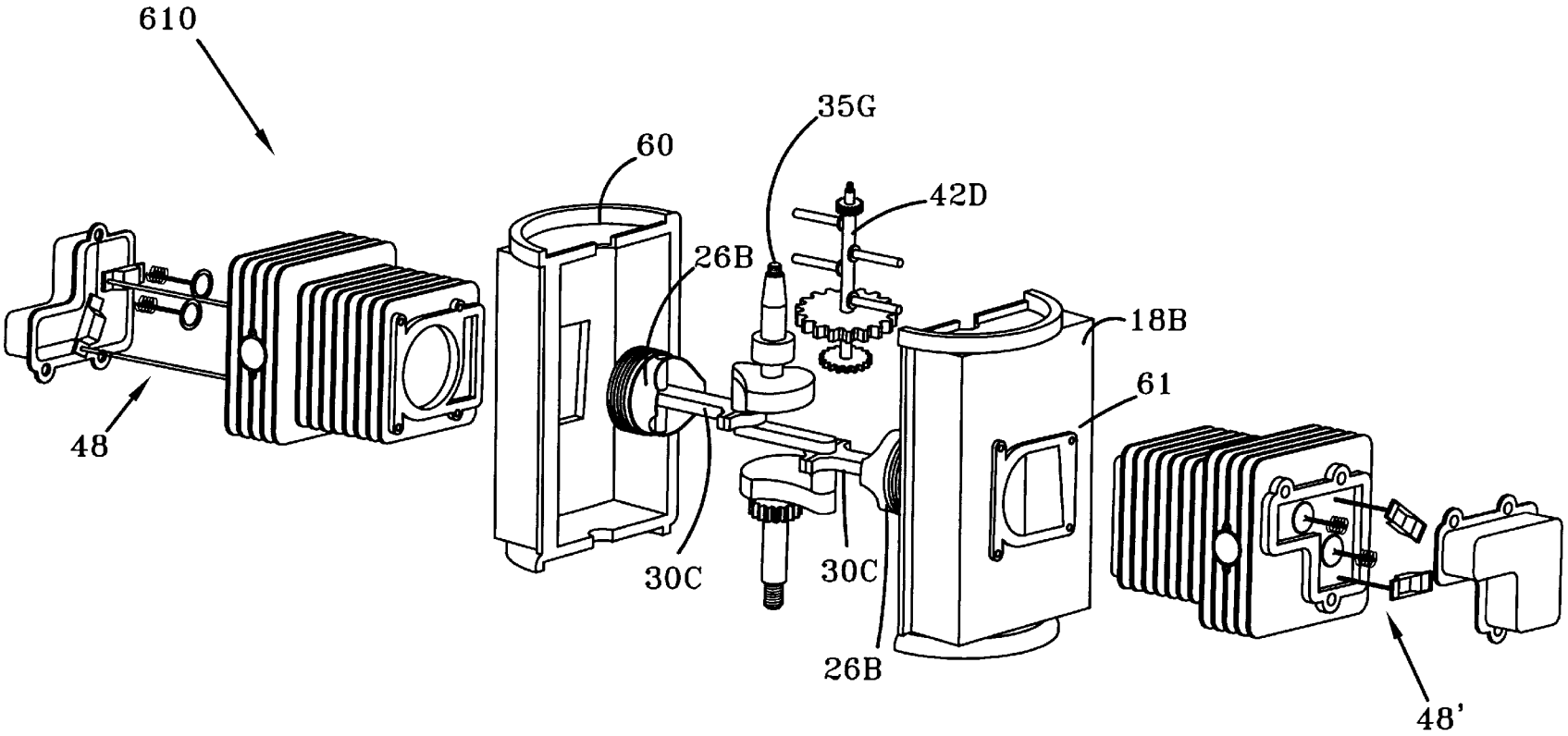
FIG. 7 is a perspective, partially exploded view of an embodiment of a seventh engine according to the invention.
Figure 8:
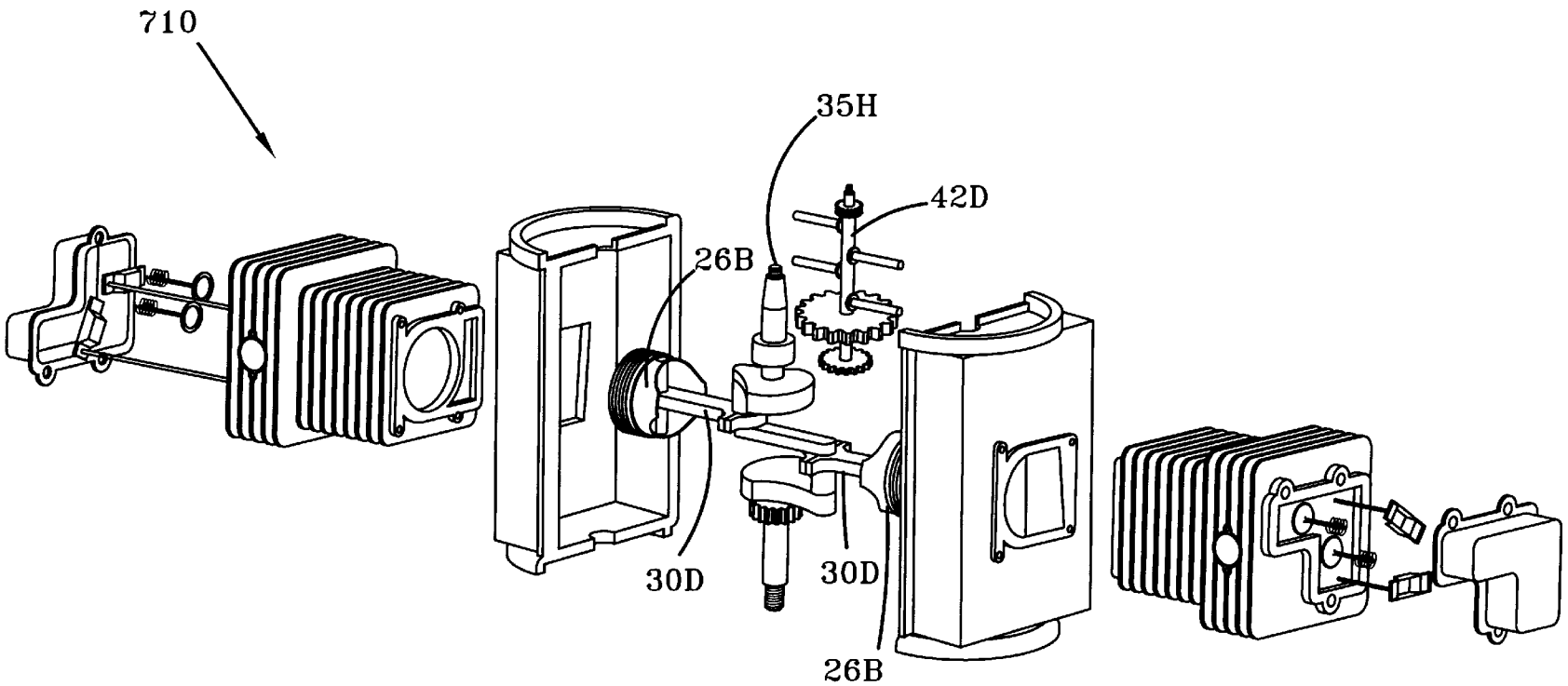
FIG. 8 is a perspective, partially exploded view of an embodiment of an eighth engine according to the invention; and, FIG. 9 is a flow chart for designing an engine conforming to a predetermined power output range according to the invention.

FIGS. 6–8 are directed to a series of engines related to fifth engine 410. The types of modifications made to basic engine 10 are repeated in this second series. For example, FIG. 6 is directed to a sixth engine 510 wherein the piston 26(B) is connected to crankshaft 35(F) by connecting rod 30D having an associated length $L_4$. $L_4$ is shorter than $L_3$ in order to allow a longer stroke for piston 26(B) and thereby provide sixth engine 510 with a greater power output than fifth engine 410. Likewise, a modified crankshaft 35(F) is utilized to accomplish the longer stroke.

FIG. 7 is directed to a seventh engine 610 having two of the larger cylinder/piston combinations. In this embodiment, each piston 26(B) is connected to yet another modified crankshaft 35(G) through connecting rods 30(C) having length $L_3$. A camshaft 42(D) analogous to 42(B) is utilized to operate the valve assemblies 48, 48'. FIG. 7 illustrates a modified crankcase 18(B) that is split into halves 60, 61 along a vertical axis. This embodiment of the crankcase can be utilized in any of the previously discussed engines without departing from the scope of the invention.

FIG. 8 is directed to yet another embodiment of the invention. The eighth engine 710 differs structurally from seventh engine 610 in that modified connecting rods 30(D) are utilized. Modified crankshaft 35H is utilized to accomplish the longer stroke of each piston 26(B). Therefore, the power output of eighth engine is greater than fifth engine 410 and sixth engine 510 (only one cylinder/piston combination) and seventh engine 610 (shorter piston stroke).

As is readily apparent to those skilled in the art, providing yet a third basic engine design would yield another series of related engines.

TABLE I

Modular Engine Design System

| Components | Basic Engine 10 | 110 | 210 | 310 |
|---|---|---|---|---|
| Cylinder Block 12 | A | A | A, A | A, A |
| Cylinder 14 | A | A | A, A | A, A |
| Piston 26 | A | A | A | A |
| Connecting Rod 30 | A ($L_1$) | B ($L_2$) | A, A | B, B |
| Crankcase 18 | A | A | B | B |
| Camshaft 42 | A | A | B | B |
| Crankshaft 35 | A | B | C | D |
| | Basic Engine 410 | 510 | 610 | 710 |
| Cylinder Block 12 | B | B | B, B | B, B |
| Cylinder 14 | B | B | B, B | B, B |
| Piston 26 | B | B | B, B | B, B |
| Connecting Rod 30 | C ($L_3$) | D ($L_4$) | C, C | D, D |
| Crankcase 18 | C | C | D | D |
| Camshaft 42 | C | C | D | D |
| Crankshaft 35 | E | F | G | H |

Table I is directed to the preferred embodiments of the family of engine designs accomplished through modifications in the first and second of basic engine designs. In the chart, the design components of the basic engine 10 are given, along with three variations (110, 210, 310). Design components of the second basic engine 410 are also given, as well as modifications thereto (510, 610, 710). It is readily seen that proving only simple alterations to the basic engine designs (10 and 410) provide engines capable of a wide range of power outputs. In the examples given above, the engines have power outputs from approximately 3.5 horsepower to up to approximately 23 horsepower.

Figure 9:
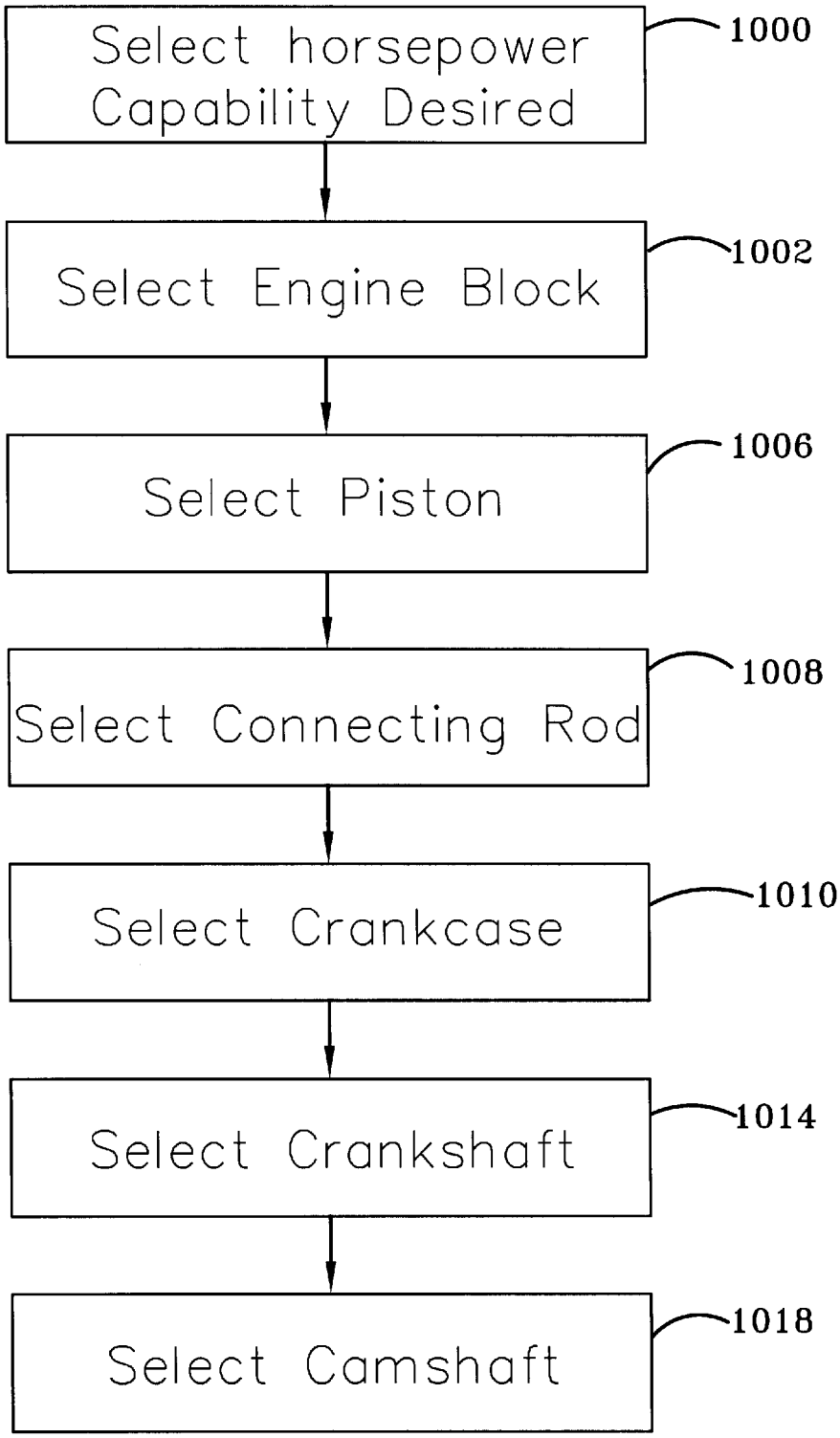

With reference to FIG. 9, a flowchart illustrating another aspect of the invention is shown. The efficiencies attributable to the invention are numerous and affect various areas of the manufacturing process. For example, because there are fewer parts due to the use of the invention, there are fewer suppliers of raw materials, components and subcomponents included in the engine. There are fewer parts to inventory. The manufacturing process will probably occupy less floor space, as multiple engine designs can most probably be built on the same production line. In FIG. 9, one such production line is illustrated in the form of a flowchart. The first block 1000 represents the step of selecting the engine design to be manufactured. For example, this document references four different engines 10, 110, 210, and 310 that can be made with a single piston size, and anther four different engines 410, 510, 610, and 710 that can be made with another, different single piston size. The selection of the particular engine will be greatly influenced by the amount of horsepower to be generated by the engine.

With continuing reference to FIG. 9, the next block 1002 illustrates the next step of selecting which cylinder block (or blocks) corresponds to the engine design selected in step 1000.

With continuing reference to FIG. 9, the next block 1006 illustrates the next step of selecting which piston corresponds to the cylinder (or cylinders) in the engine block chosen in block 1002. Depending on the engine design, one or two pistons can be chosen.

With continuing reference to FIG. 9, the next block 1008 illustrates the next step of selecting which connecting rod (or connecting rods) corresponds to the engine design selected in step 1000.

With continuing reference to FIG. 9, the next block 1010 illustrates the next step of selecting which crankcase corresponds to the engine design selected in step 1000.

With continuing reference to FIG. 9, the next block 1014 illustrates the next step of selecting which crankshaft corresponds to the engine design selected in step 1000.

With continuing reference to FIG. 9, the next block 1018 illustrates the next step of selecting which camshaft corresponds to the engine design selected in step 1000.

It is contemplated in the present invention to utilize only one camshaft 42 on engines utilizing either one or two cylinder/piston combinations. The camshaft 42 for the two cylinder engine would be similar to the camshaft used on the single cylinder engine, except that it has an extra lobe 44.

Also, the valve assembly 48 can utilize the same lobe 44 to control the intake valves 51 for both cylinders 14 in an engine employing two cylinders. The same intake valves 51 and exhaust valves 52 are utilized for the single-cylinder and the two-cylinder engines. The intake valves 51 differ in design from the exhaust valves 52.

It is contemplated in the scope of the invention to provide both horizontally and vertically aligned engines 10. In engines adapted for vertical alignment, modifications to the crankcase 18 could readily be made.

A lubrication system is contemplated based on the modular design of the engines. The oil pump can be carried on a hollow camshaft 42 and pump oil through the interior of the camshaft. The oil would travel through the camshaft up to the upper main bearing and into the crankshaft. The crankshaft could be hollow to transfer oil to the connecting rod and the lower main bearing.

The invention has been described with reference to preferred embodiment. Obviously, modifications and alterations will occur to others upon a reading and understanding of this specification. It is intended that all such modifications and alternations be included so far as they come within the scope of the appended claims or the equivalences thereof.

What is claimed is:

1. A modular engine design system for providing a plurality of related engines, wherein each engine includes at least one cylinder block defining a cylinder therein, a crankcase having an opening therein communicating with the cylinder, a piston adapted for reciprocal movement in the cylinder, a crankshaft adapted for rotational movement within the crankcase, a connecting rod interconnecting the piston and the crankshaft, and a camshaft operably associated with the crankshaft and being operable to selectively operate a valve assembly associated with the cylinder block, the modular engine design system comprising:

a first engine design for providing a basic engine associated with a first power output, said basic engine being formed of selectively replaceable basic engine components, wherein said basic engine components include:

a first cylinder block defining a first cylinder therein having first predetermined physical dimensions, a first crankcase, a first piston, said piston having first predetermined dimensions, a first camshaft, a first connecting rod having a length $L_1$, a first crankshaft, said first crankshaft and said first connecting rod operably defining a first piston stroke;

a second engine design for providing a second engine related to said basic engine wherein said second engine is associated with a second power output, said second power output being substantially different than said first power output and wherein said second engine design utilizes:

said first cylinder block defining said first cylinder therein having said first predetermined physical dimensions, said first crankcase, said first piston, said first camshaft, a second connecting rod having a length $L_2$, wherein $L_2$ differs from $L_1$, said second connecting rod selectively replacing said first connecting rod, and a second crankshaft, said second crankshaft selectively replacing said first crankshaft, said second crankshaft and said second connecting rod operably defining a second piston stroke substantially different from said first piston stroke;

a third engine design for providing a third engine related to said basic engine wherein said third engine is associated with a third power output, said third power output being substantially different from said first power output and said second power output, wherein said third engine design utilizes:

two of said first cylinder blocks each defining said first cylinder therein having said first predetermined physical dimensions, two of said first pistons, two of said first connecting rods wherein each first connecting rod is operably associated with a different one of said first pistons;

a modified crankcase, said modified crankcase selectively replacing said first crankcase, said modified crankcase having two openings therein, each of said openings communicating with a different one of said first cylinders;

a third crankshaft, said third crankshaft selectively replacing said first crankshaft, said third crankshaft and said first connecting rods operably defining third piston strokes for each of said first pistons of said third engine wherein said third piston strokes are substantially equal to said first piston stroke of said basic engine;

a modified camshaft being operable to selectively operate two of said valve assemblies, each of said valve assemblies being associated with a different one of said first cylinder blocks, said modified camshaft selectively replacing said first camshaft; and, a fourth engine design for providing a fourth engine related to said basic engine wherein said fourth engine is associated with a fourth power output, said fourth power output being substantially different than said first power output and wherein said fourth engine design utilizes:

two of said first cylinder blocks each defining said first cylinder therein having said first predetermined physical dimensions, two of said first pistons, two of said second connecting rods wherein each second connecting rod is operably associated with a different one of said first pistons, said modified crankcase, said modified crankcase selectively replacing said first crankcase, wherein each of said openings communicates with a different one of said first cylinders, a fourth crankshaft, said fourth crankshaft selectively replacing said first crankshaft, said fourth crankshaft and said second connecting rods operably defining fourth piston strokes for each of said first pistons of said fourth engine wherein said fourth piston strokes are substantially equal to said second piston stroke of said second engine, and said modified camshaft being operable to selectively operate two of said valve assemblies, each of said valve assemblies being associated with a different one of said first cylinder blocks, said modified camshaft selectively replacing said first camshaft.

2. A modular engine design system for providing a plurality of related engines, wherein each engine includes at least one cylinder block defining a cylinder therein, a crankcase having an opening therein communicating with the cylinder, a piston adapted for reciprocal movement in the cylinder, a crankshaft adapted for rotational movement within the crankcase, a connecting rod interconnecting the piston and the crankshaft, and a camshaft operably associated with the crankshaft and being operable to selectively operate a valve assembly associated with the cylinder block, the modular engine design system comprising:

a first engine design for providing a basic engine associated with a first power output, said basic engine being formed of selectively replaceable basic engine components, wherein said basic engine components include:

a first cylinder block defining a first cylinder therein having first predetermined physical dimensions, a first crankcase, a first piston, said piston having first predetermined dimensions, a first camshaft, a first connecting rod having a length $L_1$, a first crankshaft, said first crankshaft and said first connecting rod operably defining a first piston stroke; and, a modified engine design for providing a modified engine shares a common design scheme with said basic engine by sharing a common design scheme wherein said modified engine is associated with a modified power output, said modified power output being substantially different than said first power output and wherein said modified engine design utilizes:

a modified cylinder block defining a modified cylinder therein having modified predetermined physical dimensions, wherein said modified predetermined physical dimensions are substantially different than said first physical predetermined dimensions of said first cylinder, said modified cylinder block selectively replacing said first cylinder block, a modified crankcase, said modified crankcase selectively replacing said first crankcase, a modified piston, said modified piston having modified predetermined dimensions, said modified piston selectively replacing said first piston, a modified connecting rod having a length, $L_3$, said modified connecting rod selectively replacing said first connecting rod, a modified crankshaft, said modified crankshaft selectively replacing said first crankshaft, said modified crankshaft and said modified connecting rod operably defining a modified piston stroke for said modified piston of said modified engine, and a modified camshaft, said second modified camshaft selectively replacing said first camshaft.

3. A modular engine design system for providing a plurality of related engines, said modular engine design system comprising:

a first engine design for providing a basic engine, said basic engine being formed of selectively replaceable basic engine components wherein said basic engine components include:

a first cylinder block defining a first cylinder therein of first predetermined dimensions;

a first crankcase first and second substantially symmetrical portions, said first crankcase having an opening therein communicating with said first cylinder;

a first piston adapted for reciprocal movement in said first cylinder;

a first crankshaft adapted for rotational movement within the first crankcase;

a first connecting rod having a length, $L_1$, said first connecting rod operatively connecting said first piston to said first crankshaft; and, a first camshaft operably associated with said first crankshaft and being operable to selectively operate a valve assembly, wherein said basic engine is associated with a first power output; and, a second engine design for providing a second engine related to said basic engine, wherein at least one of said basic engine components is replaced with a corresponding modified engine component substantially different from said basic engine component, wherein said second engine is associated with a second power output being substantially different from said first power output.

4. The engine design system of claim 3 wherein said first piston is adapted for reciprocal movement along a piston axis and wherein said first crankcase is divided into first and second portions along a plane that is angled relative to said piston axis.

5. The engine design system of claim 3 wherein said first piston is adapted for reciprocal movement along a piston axis and wherein said first crankcase is divided into first and second portions along a plane that is substantially perpendicular to said piston axis.

6. A modular engine design system for providing a plurality of related engines, wherein each engine includes at least one cylinder block defining a cylinder therein, a crankcase having an opening therein communicating with the cylinder, a piston adapted for reciprocal movement in the cylinder, a crankshaft adapted for rotational movement within the crankcase, a connecting rod interconnecting the piston and the crankshaft, and a camshaft operably associated with the crankshaft and being operable to selectively operate a valve assembly associated with the cylinder block, the modular engine design system comprising:

a first engine design for providing a basic engine associated with a first power output, said basic engine being formed of selectively replaceable basic engine components, wherein said basic engine components include:

a first cylinder block/first piston combination, said first cylinder block defining a first cylinder therein having first predetermined physical dimensions, and said first piston having first predetermined dimensions, a first crankcase, a first camshaft, a first crankshaft; and, a first connecting rod, said first connecting rod having a length $L_1$, said first crankshaft and said first connecting rod operably defining a first piston stroke;

a second engine design for providing a second engine related to said basic engine wherein said second engine is associated with a second power output, said second power output being substantially different than said first power output and wherein said second engine design utilizes:

a second first cylinder block/first piston combination;

a modified crankcase, said modified crankcase selectively replacing said first crankcase, said modified crankcase having a second opening therein being operably associated with said second first cylinder block/first piston combination;

a pair of first connecting rods, each of said connecting rods being associated with one of said first pistons; and a modified crankshaft selectively replacing said first crankshaft, said modified crankshaft being operably associated with said pair of first connecting rods.

7. A method for manufacturing an engine having a predetermined power output utilizing an engine design system, wherein the engine design system provides engine components comprising a plurality of cylinder blocks, a plurality of pistons, a plurality of connecting rods, a plurality of crankcases, a plurality of crankshafts, and a plurality of camshafts, wherein a selection of engine components cooperate to provide said engine having said predetermined power output, the method comprising the steps of:

providing a first engine design for providing a basic engine, said basic engine being formed of selectively replaceable basic engine components wherein said basic engine components include:

a first cylinder block defining a first cylinder therein of first predetermined dimensions;

a first crankcase having first and second substantially symmetrical portions, said first crankcase having an opening therein communicating with said first cylinder;

a first piston adapted for reciprocal movement in said first cylinder;

a first crankshaft adapted for rotational movement within the first crankcase;

a first connecting rod having a length, $L_1$, said first connecting rod operatively connecting said first piston to said first crankshaft; and, a first camshaft operably associated with said first crankshaft and being operable to selectively operate a valve assembly, wherein said basic engine is associated with a first power output;

providing a second engine design for providing a second engine related to said basic engine, wherein at least one of said basic engine components is replaced with a corresponding modified engine component substantially different from said basic engine component, wherein said second engine is associated with a second power output being substantially different from said first power output;

selecting a cylinder block defining a cylinder of predetermined dimensions;

selecting a piston corresponding to said selected cylinder block;

selecting a connecting rod;

selecting a crankcase;

selecting a crankshaft; and, selecting a camshaft.

8. A method for manufacturing an engine having a predetermined power output utilizing an engine design system, wherein the engine design system provides engine components comprising a plurality of cylinder blocks, a plurality of pistons, a plurality of connecting rods, a plurality of crankcases, a plurality of crankshafts, and a plurality of camshafts, wherein a selection of engine components cooperate to provide said engine having said predetermined power output, the method comprising the steps of:

providing a first engine design for providing a basic engine associated with a first power output, said basic engine being formed of selectively replaceable basic engine components, wherein said basic engine components include:

a first cylinder block defining a first cylinder therein having first predetermined physical dimensions, a first crankcase, a first piston, said piston having first predetermined dimensions, a first camshaft, a first connecting rod having a length $L_1$, a first crankshaft, said first crankshaft and said first connecting rod operably defining a first piston stroke;

providing a second engine design for providing a second engine related to said basic engine wherein said second engine is associated with a second power output, said second power output being substantially different than said first power output and wherein said second engine design utilizes:

said first cylinder block defining said first cylinder therein having said first predetermined physical dimensions, said first crankcase, said first piston, said first camshaft, a second connecting rod having a length $L_2$, wherein $L_2$ differs from $L_1$, said second connecting rod selectively replacing said first connecting rod, and a second crankshaft, said second crankshaft selectively replacing said first crankshaft, said second crankshaft and said second connecting rod operably defining a second piston stroke substantially different from said first piston stroke;

providing a third engine design for providing a third engine related to said basic engine wherein said third engine is associated with a third power output, said third power output being substantially different from said first power output and said second power output, wherein said third engine design utilizes:

two of said first cylinder blocks each defining said first cylinder therein having said first predetermined physical dimensions, two of said first pistons, two of said first connecting rods wherein each first connecting rod is operably associated with a different one of said first pistons;

a modified crankcase, said modified crankcase selectively replacing said first crankcase, said modified crankcase having two openings therein, each of said openings communicating with a different one of said first cylinders;

a third crankshaft, said third crankshaft selectively replacing said first crankshaft, said third crankshaft and said first connecting rods operably defining third piston strokes for each of said first pistons of said third engine wherein said third piston strokes are substantially equal to said first piston stroke of said basic engine;

a modified camshaft being operable to selectively operate two of said valve assemblies, each of said valve assemblies being associated with a different one of said first cylinder blocks, said modified camshaft selectively replacing said first camshaft;

providing a fourth engine design for providing a fourth engine related to said basic engine wherein said fourth engine is associated with a fourth power output, said fourth power output being substantially different than said first power output and wherein said fourth engine design utilizes:

two of said first cylinder blocks each defining said first cylinder therein having said first predetermined physical dimensions, two of said first pistons, two of said second connecting rods wherein each second connecting rod is operably associated with a different one of said first pistons, said modified crankcase, said modified crankcase selectively replacing said first crankcase, wherein each of said openings communicates with a different one of said first cylinders, a fourth crankshaft, said fourth crankshaft selectively replacing said first crankshaft, said fourth crankshaft and said second connecting rods operably defining fourth piston strokes for each of said first pistons of said fourth engine wherein said fourth piston strokes are substantially equal to said second piston stroke of said second engine, and said modified camshaft being operable to selectively operate two of said valve assemblies, each of said valve assemblies being associated with a different one of said first cylinder blocks, said modified camshaft selectively replacing said first camshaft;

selecting a cylinder block defining a cylinder of predetermined dimensions;

selecting a piston corresponding to said selected cylinder block;

selecting a connecting rod;

selecting a crankcase;

selecting a crankshaft; and, selecting a camshaft.

* * * * *